United States Patent [19]

Chao et al.

[11] 4,372,861

[45] Feb. 8, 1983

[54] GRAPHITE DISPERSION

[75] Inventors: Tai S. Chao, Olympia Fields; Aubrey C. Smith, Jr., Harvey; Frederic D. Smies, Homewood, all of Ill.

[73] Assignee: Atlantic Richfield Company, Philadelphia, Pa.

[21] Appl. No.: 260,529

[22] Filed: May 4, 1981

[51] Int. Cl.[3] ..... C10M 1/20; C10M 1/32

[52] U.S. Cl. ..... 252/29; 252/51.5 A

[58] Field of Search ..... 252/25, 29, 51.5 A

[56] References Cited

U.S. PATENT DOCUMENTS

| | | | |
|---|---|---|---|
| 2,590,733 | 3/1952 | Stillman | 252/29 X |
| 3,384,580 | 5/1968 | Peace | 252/29 |
| 4,134,844 | 1/1979 | DeVries et al. | 252/29 |
| 4,144,166 | 3/1979 | DeJovine | 252/29 |
| 4,203,728 | 5/1980 | Norton | 44/51 |

*Primary Examiner*—Jacqueline V. Howard

*Attorney, Agent, or Firm*—Stanley M. Welsh

[57] ABSTRACT

Disclosed is a method for providing a shear stable graphite-in-oil dispersion by means of selected non-polymeric dispersing agents.

The oxygen content of the graphite particles is at least about 1% by weight of the total weight of the ground graphite particle including oxygen.

12 Claims, 1 Drawing Figure

Fig. 1 Effect of Dry Grinding Time on Particle Size, Oxygen Content & Stability
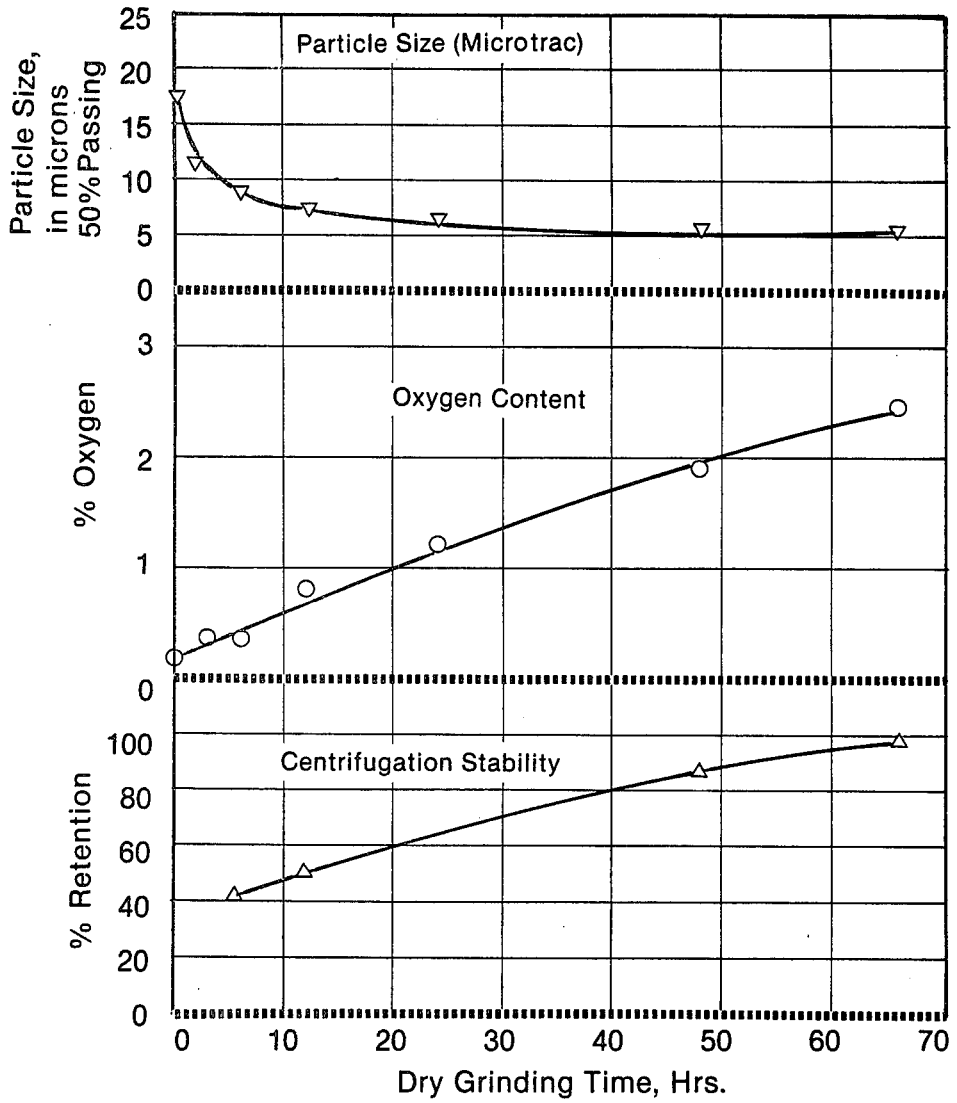

GRAPHITE DISPERSION

BACKGROUND OF THE INVENTION

Field of the Invention

The field of this invention relates to dispersions of particles in a liquid medium. More particularly, the field of this invention relates to dispersions of natural or synthetic graphite dispersions-in-oil which are suitable as a constituent of a lubricating oil composition.

U.S. Pat. No. 2,176,879 (1939) of F. E. Bartell discloses a composition comprising a dispersion of colloidal or finely divided graphite in a non-flocculated form in an organic liquid. A strongly absorbed stabilizing agent is disclosed to prevent flocculation.

U.S. Pat. No. 4,203,728 (1980) of Richard B. Norton discloses a method for preparing a slurry comprising oil and coal. Suspension stability of the coal particles in the oil is achieved by surface oxidation of the coal particle prior to preparation of the slurry. Surface oxidation of the coal could be achieved by techniques disclosed in Supplemental Volume of the text, "Chemistry of Coal Utilization" edited by H. H. Lowry, John Wiley and Son, N. Y. (1963). One of the techniques involved a fluidized bed of air and coal. Another, involved contacting coal particles with aqueous solutions of alkaline permanganate, hydrogen peroxide, ozone solutions and the like. Air oxidation in the range of 120°-350° C. was disclosed as an effective way to oxidize the surface of such coal particles.

Efforts to prepare stable graphite-in-oil dispersions by fluidized bed oxidation in air were not successful. By stable is meant, that the particles do not flocculate and/or settle out upon standing. To facilitate the process of settling, we used an International Model BE Centrifuge. A 100 ml. sample of the graphite dispersion was placed in the centrifuge and centrifugated at 900 RPM for 18 hours. A 5 ml. sample was syphoned out and its graphite content determined. From this, the percent of graphite retained was calculated and used to compare the stability of different dispersions. Stability as determined by this method is essential to the provision of an economical yield of stable graphite dispersions when the product of the wet grinding step is subjected to centrifugation or settling to remove undesirably large (greater than 6 microns) particles. It is also necessary to ensure, for example, that the lubricating properties of the graphite containing motor oil are not lost due to separation of graphite from the motor oil during long periods of storage, and that no graphite particles of their flocs will plug up pores of oil filters and lubrication passages.

In the Journal of Colloid and Interfacial Sciences 54, pgs. 22-27 (1976), there is disclosed that the stability of carbon black in a non-aqueous system of toluene varied with a molecular weight of a polystyrene dispersing agent. The stability was found generally to increase with increasing molecular weight of the polystyrene and that below a certain molecular weight, e.g., $4.2\times10^3$, the stability was poor.

The requirements for a graphite-in-oil dispersion for use in lubrication are more severe than the requirements for a coal-oil dispersion whose main purpose is transport through a pipeline. Since movement in a pipe helps to maintain the coal suspended, the requirements for a coal slurry are likely to be different from those of a graphite in oil dispersion.

Polymeric dispersants having average molecular weight of about 100,000-700,000 include two subclasses.

The first subclass includes the copolymers of long-chain alkyl methacrylates or acrylates with polar monomers such as N-vinyl pyrrolidone, and N-dialkylamino ethyl acrylamide. Examples include Acryloid 940, Acryloid 954, Acryloid 957 and Texaco TL8103. Some examples of compounds within this first subclass are disclosed in U.S. Pat. No. 3,842,009 (1974) and U.S. Pat. No. 3,506,574 (1970) which are both expressly incorporated herein by reference.

The second subclass includes copolymers of two olefins, such as ethylene and propylene, to which a polar monomer such as N-vinyl pyrrolidone or 2-vinyl pyridine optionally has been graft-polymerized. Examples include Acryloid 1155. The Acryloids are products sold by Rohm & Haas.

Some examples of compounds within this second subclass can be found in U.S. Pat. No. 3,242,075 (1966) which is expressly incorporated by reference herein. Specifically disclosed in U.S. Pat. No. 3,242,075 among others is a linear type olefin polymer having a molecular weight above about 1000 and as high as about 200,000, but preferably a molecular weight in the range of about 30,000 to about 80,000. Polyisobutylene is expressly disclosed. Other examples of compounds within this second subclass can be found in U.S. Pat. No. 3,384,580 (1968) which is expressly incorporated by reference herein. Broadly disclosed as a suitable stabilizing agent in a dispersion for use as a lubricating oil are copolymers involving ethylene and/or propylene or terpolymers involving ethylene, propylene and an unconjugated diene monomer.

As a generally well known principle, viscosities of compositions containing non-spherical particles increase without a dispersing agent as the particle size decreases. This can become extremely severe, to the point of gelation. Heating can also accelerate this process of gelation both during or after a grinding process employed to facilitate dispersion in a liquid medium.

Dispersing agents are known to be somewhat effective in overcoming the above problem. However, shear stable dispersing agents effective in overcoming the problems of increasing viscosity with graphite-in-oil dispersions were not known to the instant inventors prior to the discovery of certain non-polymeric dispersion agents discussed in more detail hereinafter.

Accordingly, a method to prepare a shear stable graphite-in-oil dispersion which is an improvement over the methods previously known is needed.

BRIEF DESCRIPTION OF THE INVENTION

It is an object of this invention to provide a method for preparing a shear stable graphite-in-oil dispersion which is more stable than ones prepared with polymeric dispersing agents having average molecular weights in excess of about 50,000.

It is an object of this invention to provide an improved process involving at least two steps which give rise to greater yields and improved shear stability for graphite-in-oil dispersions.

Other objects of this invention will be clear based upon this disclosure.

This invention includes an improved process of grinding natural or synthetic graphite and producing a shear stable graphite-in-oil dispersion. This improved process involves at least two grinding steps: a dry grinding step in an oxygen-containing atmosphere to induce partial oxygen pickup and a wet grinding step in which dry ground graphite of a previous step is simultaneously reduced to essentially submicron size and dispersed in an oil. These steps are, optionally, but preferably followed by a separation step in which large particles (those having particles greater than about 6 microns in average diameter) are removed by centrifugation, sedimentation and/or other operations. The benefit achieved by this improved process is an increased yield of shear stable dispersion subsequent to the separation step. We have found dispersion stability and yields to be strongly dependent on the oxygen content of the graphite. It was further discovered that the oxygen content of the graphite can be controlled by controlling the availability of oxygen or air during dry grinding in a ball mill.

A method of this invention involves the discovery that significant pick-up of oxygen can be made to occur during grinding of graphite in air, provided a sufficient oxygen-containing atmosphere is present and grinding is continued for a sufficient period of time.

It has been discovered that sufficiently shear stable graphite-in-oil dispersions can be obtained provided (i) that over 90% of the particles are below 1 micron in diameter, and more preferably over 95% of the particles are below 1 micron in diameter, and as based upon the total weight of the graphite particles including oxygen, the percent by weight consisting of oxygen is at least about 1%, and preferably at least about 1.3%, and (ii) a selected non-polymeric dispersing agent discussed in this specification is used. An oxygen content of above about 7.0% by weight does not appear to provide any significant additional benefits in the way of dispersion stability as herein defined. In general, a percent by weight of oxygen in the range of about 1 to about 7% is satisfactory, and preferably about 1.3% to about 5% and still more preferably about 1.5% to about 3%.

It is believed that the reason that the amount of oxygen picked up, e.g., chemisorbed on the surface, during dry grinding of graphite is a critical factor with respect to stability of graphite-in-oil dispersions is that graphite surfaces so oxidized more strongly interact with graphite dispersants. In essence, the effectiveness of graphite dispersants is dramatically improved.

Base oils suitable for the preparation of dispersions of this invention include all base oils commonly used for the production of engine oils, industrial oils and other lubricating oils and lubricants. The choice of base oil is dependent mainly on the finished lubricant in question. For engine oils, paraffinic base oils such as those produced by solvent extraction and hydrogenation processes are preferred owing to their higher viscosity index and greater oxidation resistance. For industrial oils, naphthenic base oils are often preferred on account of their greater solubility for additives, lower cost, etc. Alternately, synthetic base oils such as poly-alpha-olefins, dibasic acid esters or neopentylpolyol esters can be used where exceptional low temperature fluidity, long service life, lower viscosity index with lower volatility, cleanliness, etc. justify their higher cost.

When high viscosity and low volatility are required, oils which are commonly called bright stocks can be used.

Examples of paraffinic oils include solvent treated neutral oils having viscosity of 100–600 SUS (Sayboldt Universal Seconds) at 100° F., and VI (viscosity index) of 85–120. Base oils having similar viscosity characteristics but produced by the newer hydrocracking-hydrotreating processes can also be used.

Examples of naphthenic oils include what are commonly called pale oils of 60–2000 SUS at 100° F. and VI of 0–60. This includes naphthenic oils which have been twice hydrogenated to remove aromatic components and to improve color and stability.

Examples of bright stocks include base oils having viscosity of 2000–8000 SUS at 100° F. and VI of 60–100.

Examples of synthetic base oils include polyalphaolefins having viscosity of 2.5–10 centistokes at 210° F., di-2-ethyl hexyl azelate, di-isodecyl adipate, di-tridecyl adipate, trimethenolpropane n-heptanoate, neopentylglycol pelargonate, and the like.

The choice of base oil is also dependent on the viscosity of the dispersion desired. In general, the dispersion should not be too viscous to impair its handling characteristics. This includes pumping, filtration, centrifugation and other purification operations, as well as in blending operations. The preferred viscosity of a dispersion containing 10% graphite and used for engine oils is in the range of 100–500 centistokes at 100° F. Although viscosity of the dispersion can be controlled by a number of factors such as particle size and dispersant concentration, the viscosity of the base oil has a definite effect on the viscosity of the dispersion.

Non-polymeric dispersants of this invention which were found to provide improved shear stability have an average molecular weight in the range of about 500–10,000 and preferably about 1000 to about 5000. Examples of such dispersants include, for example, (i) Oronite 1200, a succinimide type dispersant sold by Chevron Chemical Company, and (ii) and Amoco 9250, a Mannich base type dispersant sold by Amoco Chemicals Corporation.

Examples of succinimide type dispersants useful in this invention are disclosed in U.S. Pat. Nos. 3,202,678 (1965), 3,172,892 (1965) and 3,280,034 (1966) which are expressly incorporated herein by reference. More particularly, compounds of the following formulas have been found very useful in this invention:

a mono-succinimide

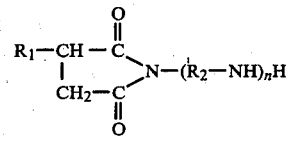

and a bis-succinimide

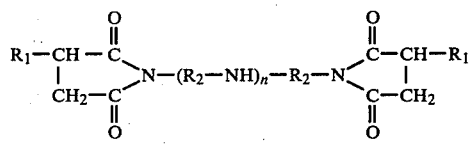

where n is in the range of about 0 to about 7 and is preferably in the case of a mono-succinimide in the range of about 4 to about 6 and is preferably in the case of a bis-succinimide in the range of about 5 to about 7;

$R_1$ is a hydrocarbyl radical, i.e. consisting essentially of carbon and hydrogen, having a molecular weight from about 400 to about 3000 and preferably having a molecular weight of from about 500 to about 1000, where the number of carbon atoms is in the range of about 30 to about 200 (where $R_1$ appears twice in the same molecule it can either be the same hydrocarbyl radical or not), and $R_2$ is a hydrocarbyl radical containing for example at least 2 carbon atoms, but less than 7 carbon atoms and preferably from about 2 to about 4 carbon atoms.

Examples of linear polyalkylpolyamines suitable for use in preparing the above succinimide type dispersants which determine $R_2$ include dithylenetriamine, triethylenetetramine and tetraethylenepentamine.

In the case of a bis-succinimide, somewhat longer polyalkylpolyamines involving $R_2$ are preferred over those that work well in the case of mono-succinimide, e.g., n preferably has a value in the range of about 5 to about 7.

The hydrocarbyl radical $R_1$ can be made by polymerizing an alpha olefin monomer of about 2 to about 5 carbon atoms with itself or other alpha olefins in ways well understood in the polymer art to produce a hydrocarbyl molecule, i.e., a molecule consisting essentially of carbon and hydrogen, containing a terminal double bond which has a molecular weight of from about 400 to about 3000. The terminal double bond is critical to maintain reactivity of the hydrocarbyl molecule in a subsequent reaction with maleic anhydride.

A preferred example of both the mono and bis-succinimide found especially useful in this invention is the reaction product from reacting polyisobutylene having a molecular weight of from about 400 to about 3000 with maleic anhydride and a linear polyalkylpolyamine. Examples of polyalkylpolyamines include diethylenetriamine, triethylenetetramine and tetraethylenepentamine or mixtures thereof.

Examples of Mannich base type dispersion agents useful for this invention are reaction products of an alkyl succinic anhydride with Mannich condensation products prepared by condensing an alkylphenol, formaldehyde and polyalkylenepolyamine as disclosed in U.S. Pat. No. 3,442,808 (1969) which is expressly incorporated herein by reference. Preferably the ratio of phenol, to formaldehyde to polyalkylpolyamine is from about 1:1:0.5 to about 1:2.5:2.

The alkyl succinic anhydride which can be used has the following formula:

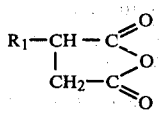

where $R_1$ is a hydrocarbyl radical, i.e. a radical consisting essentially of carbon and hydrogen, having a molecular weight in the range of about 500 to about 5,000, and preferably having a molecular weight in the range of about 1,000 to about 4,000. The alkyl phenol which can be used has the following formula:

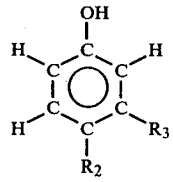

where $R_2$ and $R_3$ are independently selected from the group consisting of hydrogen and a hydrocarbyl radical containing from about 1 to about 20 carbon atoms, and preferably from about 3 to about 10 carbon atoms. Preferably, $R_2$ is a hydrocarbyl radical and $R_3$ is hydrogen. The same linear polyalkylpolyamines suitable for the succinimide type dispersants discussed hereinbefore are suitable here also. Tetraethylenepentamine is, however, preferred.

By way of illustration and not limitation, the composition of the Mannich reaction products disclosed herein may be shown structurally in accordance with the following:

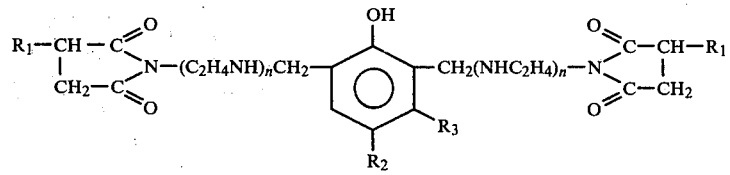

wherein

Each $R_1$ is a hydrocarbyl radical derived from polymerizing a mono-olefin having three to four carbon atoms, preferably a butylene monomer, to yield a polymer having a viscosity at 210° F. of from about 50 to 10,000 SUS;

n has a value in the range of about 0 to about 10, and is preferably in the range of about 3 to about 5; and $R_2$ and $R_3$ are individually selected from the group consisting of hydrogen and a hydrocarbyl radical having from about 1 to about 20 carbon atoms and preferably about 3 to about 10.

A boron modification of the Mannich product cited above may be carried out with boric acid, a boric acid ester, a boric anhydride, etc., at a temperature of from about 120°-400° F., using from 0.2 to 2.0 or more moles of boron per mole of modified Mannich reaction product. Although up to as high as 1.5 atoms of boron per gram atom of nitrogen can be reacted, it is desirable to have a boron to nitrogen (B/N) ratio within the range of about 0.05 to 1.0, preferably the (B/N) weight ratio is in the range of 0.10 to 0.5, inclusive.

Broadly the method for improving the yield and shear stability of a graphite-in-oil dispersion comprises at least two steps of grinding and then dispersing with a non-polymeric dispersant described above either natural or synthetic graphite. The grinding of the graphite consists of taking powders, for example, of about 100-350 mesh and grinding them to form graphite particles having an average diameter in the range of about 2 microns to about 15 microns and preferably in the range of about 5 microns to about 10 microns in the presence of an oxygen containing atmosphere so that these graphite particles have an oxygen content in the range of about 1% to about 7%, preferably about 1.3% to about 5%, and more preferably about 1.5% to about 3% of the total weight of the graphite particles including oxygen. The dispersing of the previously ground natural or synthetic graphite involves taking at least a portion of these graphite particles and stirring them into an oil to form a graphite-in-oil dispersion wherein the weight percent of said graphite particles is in the range, for example, of about 5% to about 50% and preferably about 10% to about 20% of the total weight of said graphite-in-oil dispersions. Dispersions having a weight percent of graphite less than 5% are possible, but decreasing the amount of graphite will increase the costs of transportation, storage and compounding into finished lubricating oil. On the other hand dispersions of graphite having a weight percent much in excess of about 30% are also possible, but increased concentrations of graphite can result in increased viscosity of the graphite-in-oil dispersion and decreased ease of handling.

A preferred method for grinding graphite powders for example of about 100 to about 350 mesh involves ball milling in the presence of a sufficient amount of oxygen containing atmosphere for a time sufficient, so that the resulting graphite particles will have an oxygen content in the range of about 1% to about 5% and a particle size small enough to form a stable dispersion upon wet grinding. It has been found that ball milling is the preferred method because attempts to cause similar amounts of oxygen content to be picked up by graphite particles by means of fluidized bed oxidation were unsuccessful as is shown in one of the examples. The ball milling, generally, requires in excess of 24 hours. However, grinding much in excess of 72 hours does not improve results or lead to any observable benefits.

An example of a preferred method for dispersing graphite-in-oil involves ball milling of a mixture of graphite particles having an average diameter in the range of about 2 microns to about 15 microns and preferably in the range of about 5 microns to about 10 microns with an oxygen content in the range of about 1% to about 7%, and preferably about 1.3% to about 5% and more preferably about 1.5% to about 3%.

A method for stabilizing the graphite-in-oil dispersion further involves removing some of the larger particles. Unusually stable graphite-in-oil dispersions have been found to result as a result of separating particles having an average diameter in excess of about 6 microns.

The average particle size determination for purposes of this specification is carried out by a method which relies on light scattering.

Methods for determining particle size are discussed in books such as "Particle Size Analysis" by John D. Stockham and Edward G. Fochtman, Ann Arbor Science Publishers, Ann Arbor, MI, 1977, and "Particle Size Analysis," by M. J. Groves, Heyden & Son, Inc. Philadelphia, Pa. The method of particle size used in examples of this disclosure is based on the technique of laser light scattering. This technique is discussed in publications such as "Rapid Analysis of Particle Size Distributions by Laser Light Scattering," by E. L. Weiss and H. N. Frock, Power Technology, 14, 287–293 (1976) and "Light Scattering Measurements of Particle Distributions" by A. L. Wertheimer and W. L. Wilcock, American Optics, 15, 1616–1620 (1976). Instruments based on this principle, called Microtrac Particle Size Analyzer, are manufactured by Leeds and Northrup, North Wales, Pennsylvania.

Throughout this specification and claims, a hydrocarbyl radical, group or molecule means a radical, group or molecule which consists essentially of carbon and hydrogen.

Specific embodiments of this invention given throughout the Specification and especially in the Examples are intended to be illustrative only. Variations on such specific embodiments are clear to one of skill in the art and are intended to be part of this invention.

EXAMPLE 1

Dry Grinding of Graphite

A synthetic graphite having a nominal size of 200 mesh was dry ground in an Allis Chalmer ball mill for different periods of time. The mill has a diameter of 15", length of 24" and has a small opening at one end to provide entrance of air to support oxidation. The Mill was charged with 320 pounds (lbs) of steel balls, composed of 80 lbs each of 5/32", 3/16", 7/32" and ¼" in diameter, and with 16.28 lbs of graphite. The speed of rotation was 48 RPM which was 70% of the critical speed, i.e., the speed at which the balls stop cascading or tumbling over themselves and, therefore, do not provide effective grinding action.

The progress of the grinding was followed by both the particle size and the oxygen content of the graphite. Particle size is determined by a Leeds and Northrup Microtrac Particle-Size Analyzer. This instrument provides information on particles size distribution in the range of 3–300 microns through laser beam scattering. Oxygen content of graphite was determined by heating the sample in a 750° C. tube furnace, splitting off all volatile oxygen compounds, sweeping them with helium to a reaction chamber held at 1060° C. which contained a large excess of active carbon. The latter converts all oxygen compounds into carbon monoxide which is determined quantitatively by gas chromatography. The oxygen content of the graphite is calculated from the carbon monoxide generated.

TABLE I

Effect of Dry Grinding Time on Particle Size and Oxygen Content

| Dry Grinding Time | Particle Size by Microtrac, Micron | | |
|---|---|---|---|
| Hours | 90% Passing | 50% Passing | % Oxygen |
| 0 | 54.2 | 17.5 | 0.20 |
| 3 | 27.5 | 11.7 | 0.36 |
| 6 | 17.3 | 8.6 | 0.37 |
| 12 | 15.2 | 7.2 | 0.80 |
| 24 | 13.5 | 6.3 | 1.21 |
| 48 | 10.3 | 5.5 | 1.94 |
| 66 | — | 5.6 | 2.48 |

Table I shows the particle size and oxygen content of graphite as a function of dry grinding time. It can be seen from the table, and also from FIG. 1, that the particle size reduction was the greatest during the first six hours, after which increased grinding time showed very little effect on reducing the particle size. However, the oxygen content of the graphite continues to increase steadily for the entire 66 hour period.

EXAMPLE 2

Wet Grinding and Centrifugation Stability

This example shows that grinding beyond 6 hours in order to achieve the desired oxygen content is essential in achieving improved stability.

The dry ground graphite obtained from the grinding operation of Example 1 was evaluated for their suitability for subsequent progressing steps by wet grinding in laboratory jar mills, followed by centrifugation.

A 1.33 gallon polyagonal jar mill (Model 861, Norton Company) was charged with 200 g of the dry-ground graphite. 150 g of Acryloid 940 and 500 g of a 150 SUS solvent treated paraffinic oil. About 22 lbs of ¼" steel balls were added and the jar was sealed. After grinding at 71 RPM (75% critical speed) for 24 hours another 150 g of Acryloid 940 was added and grinding continued for another 24 hours.

The dispersion obtained was placed in 100 ml centrifuge tubes and centrifuged for 18 hours at 900 RPM in an International Model BE Centrifuge. The graphite concentration of a 5 ml sample siphoned out of the middle of the tube was determined by ASTM Method D 524, the Ramsbottom Method of Carbon Residue. Results are shown in Table II.

TABLE II

CENTRIFUGATION LOSS AS A FUNCTION OF DRY GRINDING TIME

| Dry Grinding Time Hours | % O | Wet Grinding Time Hours | % Graphite Before Centri. | % Graphite After Centri. | Centri. Loss % w* | Graphite Retention % w |
|---|---|---|---|---|---|---|
| 6 | 0.37 | 48 | 18.5 | 8.0 | 56.8 | 43.2 |
| 12 | 0.80 | 48 | 18.4 | 9.3 | 49.5 | 50.5 |
| 48 | 1.94 | 48 | 19.5 | 17.0 | 12.8 | 87.2 |
| 66 | 2.48 | 48 | 18.2 | 16.3 | 10.4 | 89.6 |

*Centrifugation loss is the difference in percent by weight of graphite in the dispersion before and after 18 hours of centrifugation at 900 rpm divided by the percent by weight of graphite in the dispersion before centrifugation. Graphite retention is the difference between 100 and centrifugation loss.

It can be seen from the table that the amount of graphite retained after centrifugation increased from 43.2% at 6 hours of dry grinding to 89.6% at 66 hours. This increased stability with dry grinding time cannot be attributed to reduced particle size, since data in Table I and the plot in FIG. 1 show that particle size reduction after 6 hours was quite small. On the other hand, substantial differences exist between the oxygen content of the graphite at 6 hours (0.37%) and 66 hours (2.48%).

FIG. 1 is a plot of the relationship between dry grinding time with particle size, oxygen content and the centrifugation stability. It clearly demonstrates the importance of controlling the oxygen content of graphite during dry grinding. Without following the oxygen content of graphite, one would normally stop the dry grinding at 6 or 12 hours, since after that time not much further particle size reduction is evidenced. However, in so doing, one would end up with a dispersion of poor stability, as evidenced by the retention of only 43.2% to 50.5% of the graphite during centrifugation.

We are not certain as to why the increased oxygen content of the graphite improves the centrifugation stability. It is believed, however, that during dry grinding of graphite in a ball mill, the breakage of graphite particles is accompanied by the formation of reactive sites, favoring chemisorption of oxygen and the formation of polar oxygen-containing groups on the graphite surface. This will in turn favor the adsorption of polar compounds such as Acryloid 940 and render the latter more effective as a dispersant.

The oxygen content of graphite can be controlled by controlling the quality of oxygen available during the dry grinding step. This can either be done by providing a suitable opening in the ball mill, or, as in the case of completely sealed ball mills, by periodically replenishing the atmosphere in the mill with air, oxygen or their mixture.

EXAMPLE 3

Dry Grinding of Graphite with Periodical Replenishment of Air

This Example 3 and Examples 4–5 deal with experiments establishing workable ways of controlling oxygen content of ground graphite.

A 0.5 gallons porcelain ball mill was charged with 0.25 gallons of ¼" stainless steel balls and 100 grams of 200 mesh synthetic graphite. The mill cover was tightly placed. The graphite was ground for a period of 72 hours at a speed of 60 RPM. At the end of each 24 hours, the cover was loosened and the slight vacuum in the mill was broken by admitting fresh air. A sample of graphite was also taken to determine its oxygen content. The oxygen content of the graphite was found to be 0.94, 2.30 and 2.38 at end of 24, 48 and 72 hours, respectively.

EXAMPLE 4

Dry Grinding of Graphite with Replenishment with Air-Oxygen Mixture

A 1.33 gallon porcelain ball mill was charged with 0.5 gallons of ¼" stainless steel balls and 100 grams of 200 mesh synthetic graphite. The mill cover was equipped with a ¼" steel pipe and a needle. After sealing the cover, the mill was evacuated three times, each followed by recharging to atmospheric pressure with a mixture of air and oxygen containing 40% oxygen. The grinding was carried out for a period of 48 hours. At the end of 24 hours, the mill was again evacuated and recharged with the air/oxygen mixture. The graphite obtained in this experiment contained 3.07 and 6.18% oxygen after 24 and 48 hours.

EXAMPLE 5

Dry Grinding of Graphite with Insufficient Oxygen

A 1.4 gallon porcelain ball mill was charged with 2675 ml of ¼" stainless steel balls and 800 grams of 200 mesh synthetic graphite. The mill was sealed and the graphite was ground for a period of 48 hours. At the end of every 12 hours, the cover was loosened to admit fresh air. The graphite obtained in this experiment was found to contain 0.24, 0.44, 0.68 and 0.82% oxygen at end of 12, 24, 36 and 48 hours.

Examples 3–5 show that the oxygen content of graphite obtained in the dry grinding step is highly dependent on the availability of oxygen, that it increases with increased free space in the mill per unit weight of graphite and with increased oxygen concentration in the free space. In a commercial operation, it is believed that the easiest way to control oxygen content is by providing a controlled access of air through a properly designed opening in the mill. The size of this opening will be necessarily dependent on the design of the ball mill and the flow rate of the graphite through the mill. But, the oxygen content of graphite can be monitored by taking samples and analyzing them by the method disclosed in Example 1.

On the other hand, our experiments indicated that the oxygen content of graphite cannot be readily increased in the absence of grinding. Literature indicates that graphite is resistant to oxidation by air up to 600° C. and above this temperature any oxidation product formed on the surface will be decomposed to carbon monoxide and carbon dioxide. Thus, any attempt to increase the oxygen content of graphite by air oxidation without grinding is believed to be futile.

EXAMPLE 6

Attempted Oxidation of Dry Ground Graphite

A fluidized bed reactor was constructed from a vertical quartz tube with an I.D. of 3¼" and height of 48". A feed of 300 grams of graphite which was dry ground for 24 hours in a 15" ball mill (see Example 1) was placed on a quartz frit. The frit was 10" above the bottom of the tube and the graphite occupied a height of about 18". The reactor was surrounded by a tube furnace. Filtered compressed air at 15–20 psig was passed through the graphite bed at a rate of 60–75 liters/hours (calibrated to STP). The graphite did not fluidize well and had to be stirred with a mechanical stirrer at about 60 RPM to avoid channeling. Two experiments were conducted, one at 120° F. and one at 300° F., and both for a period of 25 hours. Results are shown in TABLE III.

TABLE III

| Experiment | Temperature % F. | Time Hrs. | % Oxygen Feed | % Oxygen Product |
|---|---|---|---|---|
| 1 | 120 | 25 | 1.21 | 1.32 |
| 2 | 300 | 25 | 1.21 | 1.22 |

These results clearly indicate that no significant oxidation was achieved under the experimental conditions. It is believed that oxidation of graphite during grinding is achieved by the breaking of C—C bonds, creating reactive sites and causing the irreversible chemisorption of oxygen. This series of events are not encountered in the absence of fracturing.

EXAMPLE 7

This example shows that a dispersion prepared with Oronite 1200 as dispersant have no tendency to increase in viscosity upon heating.

A graphite dispersion was prepared by grinding in a 1.5 gallon Model 1-S Attritor, a stirred ball mill manufactured by Union Process, Inc., 2500 gms of a slurry containing 26.5% graphite powder (same as that for Example 5) 31.5% of Oronite 1200 and 42.0% a 100 SUS at 100° F. paraffinic base oil. The grinding was proceeded at 115°–125° F., 300 RPM, for a period of 36 hours. The dispersion obtained showed a Brookfield viscosity of 686 centipoise (cp) at 100° F. and 100 cp at 210° F., as determined in Type LVF Brookfield Viscometer equipped with Thermosel, a small sample chamber heated electrically. The viscosity was determined with spindle No. SC4-31 at a speed of 30 RPM. After the initial determination of viscosity, this sample was kept at 210° F. for a period of 24 hours. Its viscosity at 210° F. was again determined and found to be 94 cp. Its temperature was allowed to drop to 100° F. and a final 100° F. viscosity was determined which turned out to be 623 cp. The small variations in viscosity readings are due to the difficulty in obtaining accurate readings with small samples. The fact that both the 100° F. and 210° F. viscosity did not increase during the 24-hour period demonstrates the excellent viscosity stability of the dispersion. In contrast, dispersions such as those disclosed in Examples 10 to 11 increased in viscosity during the short period (less than 30 minutes) in which the sample was heated to 210° F.

In another experiment, the same dispersion was heated in a Thermosel to 310° F. Its viscosity of 80 cp determined at a shear rate of 13.2 $sec^{-1}$, indicated that no thickening occurred even at this temperature.

EXAMPLE 8

This example shows that a bis-succiminide type dispersant, Oronite 373 C, is also effective as a dispersant for graphite dispersions. The dispersions produced do not have the high viscosity and indications of the thermal thickening problems seen with polymeric dispersants.

A slurry of 750 grams of dry ground graphite powder (same as that used in Example 11), 1000 grams of Oronite 373 C and 750 grams of a 100 SUS paraffinic base oil was ground in 1-S Attritor at 115°–125° F. and 300 RPM for 36 hours. The final Brookfield viscosity was 1525 cp at 100° F. and 88 cp at 210° F. The lower viscosity at 210° F. demonstrates the absence of thermal thickening. At 24 hours, the 30% graphite dispersion had a 100° F. Brookfield viscosity (at 2.04 $sec^{-1}$) of 1400 cp. This compares favorably with the 1342 cp obtained for Example 3 at 20% graphite, when the effect of graphite concentration is taken into account.

The stability of this dispersion was determined by diluting to 1% graphite with a 150 SUS paraffinic base oil containing 1% water and storing in a 248° F. oven for a period of four weeks. At the end of each week, the sample was examined under an optical microscope for extent of flocculation. No flocculation was seen.

EXAMPLE 9

This example shows that a Mannich base type dispersant Amoco 9250 is effective as a shear resistant dispersant and that the dispersion showed no thermal thickening problem.

A slurry of 750 grams of preground graphite (same as that used in Example 3), 1250 grams of Amoco 9250 and 500 grams of 100 SUS paraffinic base oil was ground for 36 hours in 1-S Attritor, at 120°–125° F. and 300 RPM. The 30% graphite dispersion showed a final Brookfield viscosity of 3225 cp at 100° F. and 162 cp at 210° F. The fact that at 210° F. viscosity is considerably lower than the 100° F. viscosity indicated that the dispersion has no tendency to increase its viscosity upon heating.

The dispersion, when diluted to 1% graphite and stored for four weeks in the same manner as discussed in Example 8, showed no flocculation for the entire four-week period.

EXAMPLE 10

Three hundred grams of a synthetic graphite of nominal 200 mesh was fed into a 1.4 gallon stirred ball mill (Union Process Attritor 1-S) containing 0.7 gallon of ⅛" steel balls. To this was added 1250 grams of 150 SUS paraffinic bas oil. The slurry was ground at a speed of 300 RPM for a period of 40 hours. The viscosity of the slurry was monitored by withdrawing a sample periodically and measuring it in a Brookfield Viscometer, using a sheer rate of 4.18 $sec^{-1}$. At 24 hours, 450 grams of Acryloid 940, a polymeric dispersant, was added. The following data shows that viscosity of the slurry increases rapidly with grinding that viscosity at 210° F. exceeded that at 100° F. after 4 hours, that Acryloid 940 reduced viscosity of the dispersion drastically, and that, even with the use of Acryloid 940, the dispersion at end had a very high viscosity and it thickened on heating to 210° F.

| Time, hrs. | Brookfield Viscosity Centipoise | |
|---|---|---|
| 0.1 | 100° F. | 210° F. |
| 4 | 150 | 75 |
| 8 | 4,425 | 8,360 |
| 16 | 13,800 | 18,750 |
| 24 | 50,000 | — |
| 32 | 100,000* | — |
| 40 | 2,500 | 22,000 |
| | 3,520 | 45,000 |

*Estimated from viscosity of two diluted samples.

EXAMPLE 11

A commercial synthetic graphite was dry ground in an Allis chalmers tumbling ball mill of 4 feet diameter and 6 feet length. The graphite powder obtained had a mean particle diameter of 13.0 microns, specific surface area of 1.06 $m^2$/c.c., 90% of these particles were below 31.1 microns, 50% below 6.42 microns, and 10% below 2.5 microns. This was determined by a Microtrac particle size analyzer from Leeds & Northrup, using the principles of laser scattering. This graphite powder also contained 2.19% oxygen.

About 500 grams of this graphite powder was placed in the 1-S Attritor described in Example 7 containing 15,000 grams of steel balls. To this were added 375 grams of Acryloid 940 and 1250 grams of the 150 SUS paraffinic base oil. The slurry was ground at 90°-94° F. for a period of 48 hours. The Brookfield viscosity of the slurry at 100° F. increased from 550 centipoise at 12 hours to 1,342 centipoise at 24 hours. At the end of 48 hours, the slurry was so thick that no sample was withdrawable from the Attritor. However, upon addition of 375 grams more of Acryloid 940 and stirring for 15 minutes, the product was able to be discharged. It showed a Brookfield viscosity of 2,788 centipoise at 100° F. and 7,625 centipoise at 210° F.

The invention which is claimed is:

1. A method for improving the yield and stability of a graphite-in-oil dispersion comprising: grinding graphite powders to form graphite particles having an average diameter in the range of from about 2 microns to about 15 microns in the presence of an oxygen-containing atmosphere so that said graphite particles have an oxygen content in the range of about 1% to about 7% of total weight of the graphite particles including oxygen, and dispersing at least a portion of said graphite particles into an oil to form a graphite-in-oil dispersion wherein a dispersing amount is added during said dispersing of a dispersing agent selected from the group consisting of:

(i) a mono-succinimide of the following formula:

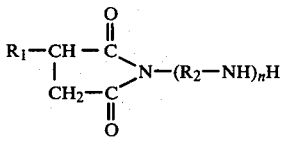

wherein:

n is in the range of about 0 to about 7;

$R_1$ is hydrocarbyl radical having a molecular weight in the range of from 400 to about 3000; and $R_2$ is a hydrocarbyl radical having from about 2 to about 7 carbon atoms;

(ii) a bis-succinimide of the following formula:

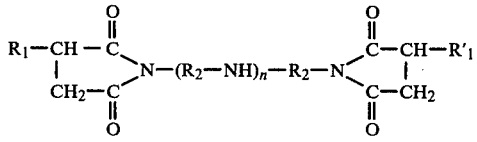

wherein:

n is in the range of about 0 to about 7;

$R_1$ and $R_1'$ are independently selected hydrocarbyl radicals each having a molecular weight in the range of from about 400 to about 3000; and $R_2$ is a hydrocarbyl radical having from about 2 to about 7 carbon atoms; and (iii) a compound having the following formula:

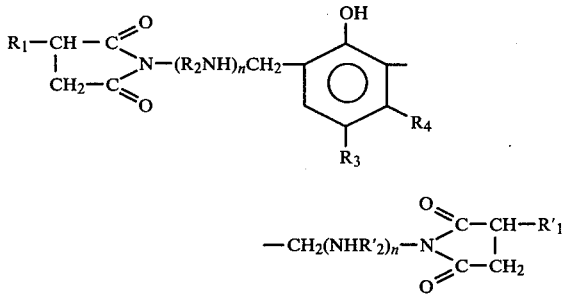

wherein:

n is in the range of from about 0 to about 7;

$R_1$ and $R_1'$ are independently selected from the group of hydrocarbyl radicals having a molecular weight in the range of about 500 to about 5000;

$R_2$ and $R_2'$ are independently selected hydrocarbyl radicals each containing from about 2 to about 7 carbon atoms; and $R_3$ and $R_4$ are independently selected from the group consisting of hydrogen and a hydrocarbyl radical containing from about 1 to about 20 carbon atoms.

2. The method of claim 1, wherein said grinding comprises ball milling in the presence of a sufficient amount of oxygen-containing atmosphere for a time sufficient to cause said graphite particles to form graphite particles having said oxygen content and said average diameter in said range.

3. The method of claim 2, wherein said time is in excess of about 12 hours and less than about 72 hours.

4. The method of claim 1, wherein said dispersing involves ball milling for a time sufficient to disperse said graphite particles having an average diameter in the range of about 5 microns to about 10 microns to form a graphite-in-oil dispersion.

5. The method of claim 1 or 4, wherein particles having an average diameter in excess of about 6 microns are separated from said graphite-in-oil dispersions, whereby a very stable graphite-in-oil dispersion is formed.

6. The method of claim 1, 2, 3 or 4, wherein said oil used in said graphite-in-oil dispersion is selected from the group consisting of paraffinic and naphthenic lubricant base oils.

7. The method of claim 1, wherein the dispersing amount added during said dispersing is of a compound having the formula:

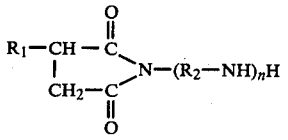

wherein:

n is in the range of from about 0 to about 7;

$R_1$ is hydrocarbyl radical having a molecular weight in the range of from about 400 to about 3000; and $R_2$ is a hydrocarbyl radical having from about 2 to about 7 carbon atoms.

8. The method of claim 1, wherein the dispersing amount added during said dispersing is of a compound having the formula:

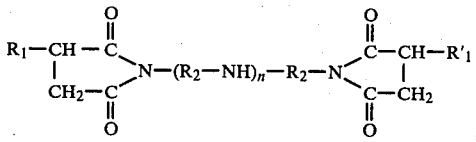

wherein:

n is in the range of about 0 to about 7;

$R_1$ and $R_1'$ are independently selected hydrocarbyl radicals each having a molecular weight in the range of from 400 to about 3000; and $R_2$ is a hydrocarbyl radical having from about 2 to about 7 carbon atoms.

9. The method of claim 1, wherein the dispersing amount added during said dispersing is of a compound having the formula:

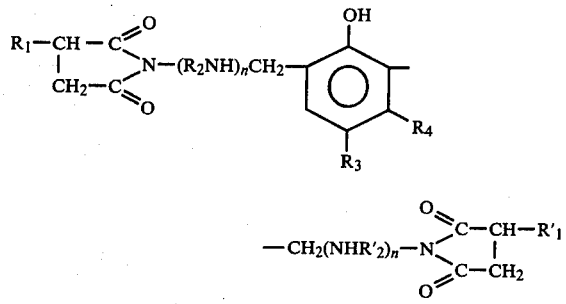

wherein:

n is in the range of from about 0 to about 7;

$R_1$ and $R_1'$ are independently selected from the group consisting of hydrocarbyl radicals having a molecular weight in the range of about 500 to about 5000;

$R_2$ and $R_2'$ are independently selected from the group of hydrocarbyl radicals containing from about 2 to about 7 carbon atoms; and $R_3$ and $R_4$ are independently selected from the group consisting of hydrogen and a hydrocarbyl radical containing from about 1 to about 20 carbon atoms.

10. The method of claim 7, wherein $R_1$ has a molecular weight in the range of from about 500 to 1000, $R_2$ has from about 2 to about 4 carbon atoms, and n is in the range of from about 4 to about 6.

11. The method of claim 8, wherein $R_1$ and $R_1'$ each has a molecular weight in the range of from about 500 to 1000, $R_2$ has from about 2 to about 4 carbon atoms, and n is in the range of from about 5 to about 7.

12. The method of claim 9, wherein $R_1$ and $R_1'$ are each independently selected from the group of hydrocarbyl radicals having a molecular weight in the range of about 1000 to about 4,000, $R_2$ and $R_2'$ are independently selected from the group of hydrocarbyl radicals containing from about 2 to about 4 carbon atoms, $R_4$ is hydrogen and $R_3$ is selected from the group of hydrocarbyl radicals containing from about 3 to about 10 carbon atoms.

* * * * *